United States Patent [19]

Shepard

[11] Patent Number: 4,602,259

[45] Date of Patent: Jul. 22, 1986

[54] POLAR MOUNT ANTENNA SATELLITE TRACKING APPARATUS AND METHOD OF ALIGNMENT THEREOF

[76] Inventor: John O. Shepard, P.O. Box 166, Saxtons River, Vt. 05154

[21] Appl. No.: 397,306

[22] Filed: Jul. 12, 1982

[51] Int. Cl.[4] ..... H01Q 3/00

[52] U.S. Cl. ..... 343/359; 343/882; 33/268

[58] Field of Search ..... 343/359, 757, 763, 766, 343/878, 880, 882; 364/516, 455; 33/268

[56] References Cited

U.S. PATENT DOCUMENTS

| | | | |
|---|---|---|---|
| 3,464,116 | 9/1969 | Kissell | 33/268 |
| 4,232,320 | 11/1980 | Savalle, Jr. | 343/882 |
| 4,257,048 | 3/1981 | Yokoi et al. | 343/766 |
| 4,454,658 | 6/1984 | Lewis et al. | 33/268 |

*Primary Examiner*—Theodore M. Blum

*Attorney, Agent, or Firm*—Sughrue, Mion, Zinn, Macpeak & Seas

[57] ABSTRACT

A polar mount for a parabolic satellite tracking antenna insures close tracking of the antenna to a synchronous satellite track sector bearing multiple satellites within the earth's equatorial plane. The apparatus tilts the polar pivot axis of the antenna and the dip of the antenna boresight to cause an elliptical antenna track which better approximates the track of the synchronous satellite. The antenna is provided with a removable Polaris telescope alignment fixture to permit selective adjustment of the tilt angle at a sine setting derived from specific formula prior to aligning the antenna mount for true north and with further ajustment for dip angle or declination to achieve alignment accuracy within thirty arc-seconds of the antenna boresight to the satellite track sector bearing the satellites whose signals are to be received. A zero backlash linear actuator selectively drives the antenna about the polar axis to sweep the satellite track sector, with exacting alignment, from satellite to satellite.

10 Claims, 7 Drawing Figures

POLAR MOUNT ANTENNA SATELLITE TRACKING APPARATUS AND METHOD OF ALIGNMENT THEREOF

FIELD OF THE INVENTION

This invention relates to equipment for receiving television signals via satellite and more particularly to an improved polar mount for a parabolic antenna or the like and to a fixture, as an element thereof or as an attachment thereto, for maximizing the alignment between the antenna and a synchronous satellite in the earth's equatorial plane.

BACKGROUND OF THE INVENTION

In the past few years, parabolic reflectors of nine, twelve feet, etc., in diameter, have been employed at sites within the North American hemisphere for receiving television signals by aiming the antenna at a chosen geosynchronous satellite within an equatorial satellite track and in particular with respect to a limited sector of that track, bearing a series of closely spaced satellites.

The importance and necessity of accurately aligning the focal axis or boresight of the antenna with a chosen satellite can be appreciated when it is understood that the satellites are beaming television signals to the continental United States, a broadcasting distance of 25,000 miles or so, with a power of only five watts. Further, along their orbital track in the plane of the equator, they are separated by as little as four degrees and are likely to be more closely spaced as future satellites are launched. It is only in the equatorial plane that synchronous orbit can be achieved, whereby even at a distance of 25,000 miles or so, the satellites vary their positions by no more than one-half mile. Specifically, the parabolic receiving antenna is so highly directional that as little as a one-fourth degree misdirection may result in significant loss of signal quality.

There are two basic types of mount: one is the two axis type where, by azimuth and elevation adjustment, the parabolic receiving antenna is provided with some degree of alignment between the focal axis of the antenna and the satellite selected from the group of satellites within a given sector with the aximuth and elevation adjustments being undertaken with consideration to latitude and longitude position of the antenna on the earth's surface.

While this type works satisfactorily when there is a single satellite to which the antenna is to be focussed, the industry utilizes a so-called "polar mount", which is highly favored, when any one of a number of satellites must be conveniently chosen and where the orientation of the antenna may be changed at random, depending upon the television programs broadcast by the various satellites. The function of the polar mount is to direct the antenna towards a chosen satellite by pivoting the antenna on a single axis with no further adjustment required after desired latitude and longitude presetting is effected. The polar mounts presently supplied for use with TVRO (television receive only) installations fail to do this with sufficient accuracy except at limited geographical areas where the signals are strongest and where certain errors inherent in the alignment process are the least. In locations removed from the most favorable positions, these deficiencies are overcome by the use of larger antennas, more sophisticated radio frequency amplifiers, or both. These are relatively costly solutions compared with improving the performance of the mount itself.

It is therefore a primary object of the present invention to provide a polar mount incorporating a fixture, as an attachment to or integrated with a polar mount, which fixture can be set in accordance with information related to the latitude of the antenna site which insures alignment of the mount for the antenna relative to the satellite to a known degree of accuracy and one which is much higher than that achievable in the past.

It is a further object of the present invention to provide such a polar mount, or a fixture as an attachment thereto, which makes use of information developed mathematically to provide a more sophisticated alignment procedure and a structural combination facilitated by the fixture itself which permits rapid, accurate alignment of the antenna to the satellite track and in which the fixture may be readily adjusted from data derived by way of a computer program using the mathematical formulae.

It is a further object of the present invention to provide an improved polar mount adapted physically to use the aligning fixture and which will readily maintain the resulting accuracy in service over an appreciable time period irrespective of weather conditions experienced by the antenna.

DESCRIPTION OF THE PREFERRED EMBODIMENT

The present invention is based on particular discoveries and to a Polaris telescope alignment fixture integral with the polar mount or as a separate attachment thereto, to maximize the alignment between the focal axis or boresight of the antenna and the orbital track of the TVRO synchronous satellite within the earth's equatorial plane.

Figure 1:
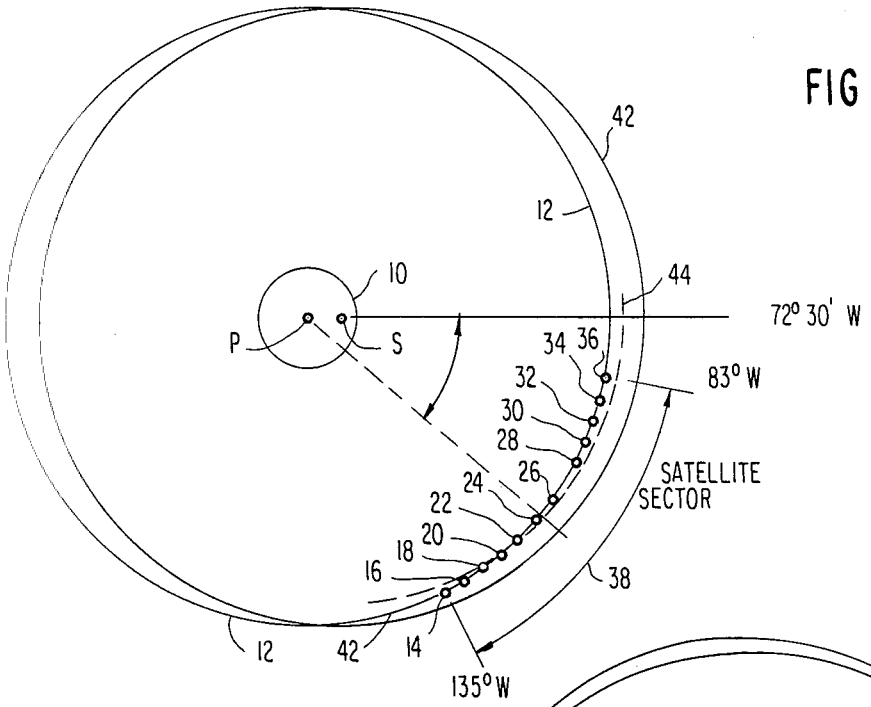
FIG. 1 is a schematic representation of the earth, a satellite track of synchronous satellites positioned in the equatorial plane and an antenna boresight track on the equatorial plane from the site of a TVRO antenna evidencing the problems solved by the present invention.

In order to appreciate the need for the present invention, reference may be made to FIG. 1 which shows the problem in attempting to achieve the desired alignment. One must imagine that one is looking down on the northern hemisphere from Polaris, the North Star, the earth appearing as at 10 at the center of the geometric diagram. In the plane of the equator there is shown a first circle centered at the earth polar axis P with the radius of 26,279 miles. This circle 12 is the orbital track of a series of TV synchronous satellites 14, 16, 18, 20, 22, 24, 26, 28, 30, 32, 34 and 36, shown at positions which they always hold along the track 12. The satellites presently span between longitudinal positions 83 degrees west, back through 135 degrees west, forming a satellite sector 38 which has a center somewhere near satellite 26, as depicted. In addition to the earth's polar axis P, there is shown on earth 10 the position on site S of an earth TVRO parabolic antenna 50. Assuming that its pivot axis is aligned parallel to the polar axis P, as closely as a hand-held compass and clinometer will allow, and the focal axis (or boresight) is declined a suitable amount from about 4 to about 8 degrees depending upon the latitude location of the antenna site S, the focal axis or boresight intersects the equatorial plane in another circle indicated at 42 which overlaps the first circle, that is, satellite track 12.

The distance between the outlines of the two circles, that is, of track 12 and circle 42 in a given direction from the site S of the antenna, is mathematically related to the boresight error in that direction; the closer the outlines, the lesser the error, and vice versa.

In practice, declination or dip of the boresight must be increased in order to decrease the radius of the boresight track to thereby average the error or difference between the boresight track and the satellite track 12 at any given location.

In FIG. 1, a portion of the corrected boresight track in the vicinity of the satellite sector 38 is shown, as at 44. The dotted line corrected boresight track 44 intersects the satellite track approximately midway along the sector 38 and departs from it towards either end, that is, lying outside of the satellite track 12 from the center towards the 83 degree west extremity of that sector, while lying inside of the track moving from the center of the sector, in the vicinity of satellite 26, towards the 135 degree west longitude extremity.

The departure represents minimum error by the accepted method of alignment, for the site S as depicted, which has been calculated to be approximately 0.213 degrees, assuming the pivoting axis for the antenna 50 is perfectly parallel to the polar axis P of the earth 10. Limitations of the method and in the design of mounts in current use invalidate this assumption and, in fact, make it impossible to know the amount of additional error introduced at random in the process of alignment and functioning of the mount.

The applicant has realized by studying FIG. 1 that the boresight track 42 actually represents the intersection with the equatorial plane of a cone whose apex is at the earth surface site S for antenna 50, generated by rotating the declined boresight line around the pivotal axis of the mount and has determined that if the axis of the cone were to be tilted away from the polar axis (to which it is supposed to be parallel), then the boresight track would tend to approach the satellite track. From this appreciation, formulae have been developed based on the image described above.

Figure 2:
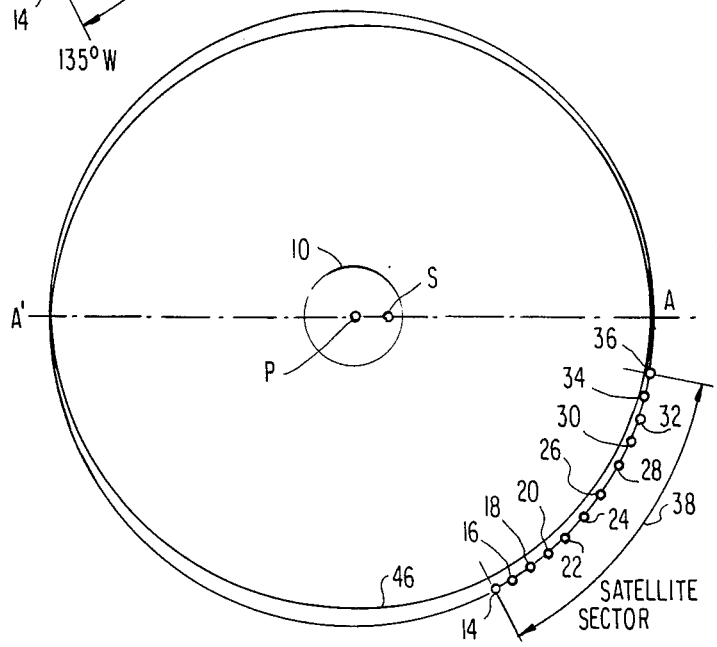
FIG. 2 is a similar schematic diagram to that of FIG. 1, evidencing applicant's discovery of the structural features for a Polaris finder telescope fixture to facilitate the polar mount alignment of a TVRO antenna with a sector of the satellite track bearing desired satellites whose signals are to be selectively received.

Turning next to FIG. 2, this figure shows the satellite track again at 12, the earth at 10 and the polar axis for the earth at P. However, there is provided a new boresight track as at 46.

Under the arrangement where the cone is tilted away from the polar axis, the new boresight track 46 is an ellipse rather than a circle and is tangent to the satellite track 12 at both ends of its long axis 48, passing through the polar axis P of earth 10. The axis of the boresight cone has thus been purposely tilted out of parallel to the polar axis P in the plane of the longitude through the site S by a calculated amount to generate precisely the ellipse.

Figure 3:
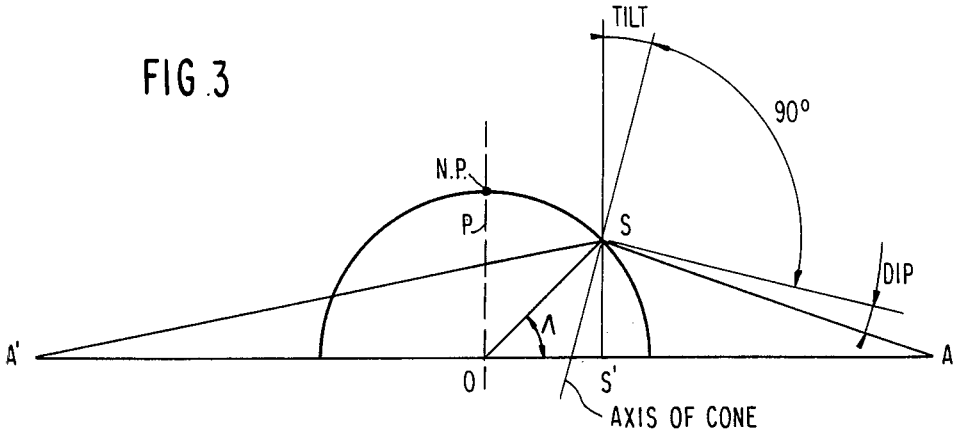
FIG. 3 is a schematic representation of the geometrical relationship of the earth borne antenna facilitating the determination of given tilt and dip angles at the latitude of the antenna for maximizing alignment between the antenna focal axis or boresight and the satellite track of FIGS. 1 and 2.

Turning next to FIG. 3, this is a geometrical representation of the relationships upon which the mathematical formulae have been developed for determining the exact tilt and dip angles for the antenna for any latitude. It should be emphasized that by "dip" is meant the normal and natural declination needed to align the antenna boresight with the satellite track sector when the antenna rotation axis is parallel to the polar axis of the earth and a circle is developed in the earth's equatorial plane thereby intersecting the plane bearing the satellite track 12. However, by the present invention, the conventionally calculated value for dip, for a given latitude, is modified to accommodate the new element of tilt. The mathematical relationship of the two elements is described below.

Referring to FIG. 3, it may be seen that the site S latitude of approximately 45 degrees is purposely selected with the longitude outside of the satellite sector 38 and remote from the center of the satellite sector by nearly 40 degrees. To find the angle of "tilt" and the angle of "dip" at a given latitude angle Λ:

Tilt equals half the difference between the angles SAO and SA'O, and:

Dip equals half the sum of the angles SAO and SA'O, where:

S is the site of the antenna on the surface of the earth 10,

0 is the center of the earth,

A is the intersection point of the cone subscribed by rotating the boresight track at the intersection with the equatorial plane at the longitude of the site S, closest to the satellite track sector, and A', is the cone intersection point in the equatorial plane, 180 degrees displaced from intersection point A.

AO equals A'O and is equal to the radius of the satellite orbit equal to 26,279 miles;

SO equals the radius of the earth assumed to be 4,000 miles;

then, $$\text{angle } SAO = \tan^{-1} \frac{4{,}000 \text{ sine } \Lambda}{26{,}279 - 4{,}000 \cos \Lambda'} \text{ and;}$$

$$\text{angle } SA'O = \tan^{-1} \frac{4{,}000 \text{ sine } \Lambda}{26{,}279 + 4{,}000 \cos \Lambda}.$$

It should be noted that the radius of the earth is taken to be 4,000 miles for illustration purposes only. The earth is actually approximately 3,963 miles in radius.

It might be noted that very similar formulae would define an ellipse tangent at its short axis to the satellite track producing like accuracy and the invention is without preference.

Utilizing the formulae developed above, applicant has developed a computer program providing a printout for tilt and dip for relevant latitude, in the closest useful increments. The printout, a portion of which follows, includes a column of figures under the heading "Sine Set" whose significance will be readily evident hereinafter:

| LATITUDE | TILT | SINE SET | DIP |
|---|---|---|---|
| 25 DEG 0 MIN | 0.516 DEG | .0450 | 3.75 DEG |
| 25 DEG 10 MIN | 0.519 DEG | .0453 | 3.77 DEG |
| 25 DEG 20 MIN | 0.521 DEG | .0455 | 3.80 DEG |
| 25 DEG 30 MIN | 0.523 DEG | .0457 | 3.82 DEG |
| 25 DEG 40 MIN | 0.526 DEG | .0459 | 3.84 DEG |
| 25 DEG 50 MIN | 0.528 DEG | .0461 | 3.87 DEG |

As may be appreciated, the final correction to average the remaining error, shown in FIG. 1 as dotted line 44, is not shown in FIG. 2 because in the satellite sector 38, the tracks are already too close together; however, the averaging procedure will still take place. Dip would then be adjusted to shift the boresight track so as to fall inside the satellite track at one end of the sector and outside it at the other by the same distance, thereby insuring exact alignment at the center of the sector. The calculated maximum error at the site S chosen for illustration in the figures for a polar mount aligned by the method and apparatus of the present invention is 44 arc-seconds.

Again, it should be emphasized that the site S, chosen for illustration, is close to 45 degrees latitude and nearly 40 degrees east of the center of the present satellite sector and lying in an area where the inherent polar sighting error is greatest and where satellite signals are relatively weak.

In addition it should be emphasized that maximum vertical boresight error from horizon to horizon, of an antenna thus aligned, would not exceed one minute of arc, at latitude 45°, where inherent error is greatest, diminishing in latitudes north or south.

Turning to the computer printout figures above, the order of accuracy to which a polar mount must be aligned in order positively to achieve such boresight accuracy is readily seen. The technique and apparatus employed in the present invention utilizes the only known reference both accurate enough to start from and readily enough available which is Polaris, the North Star.

Figure 4:
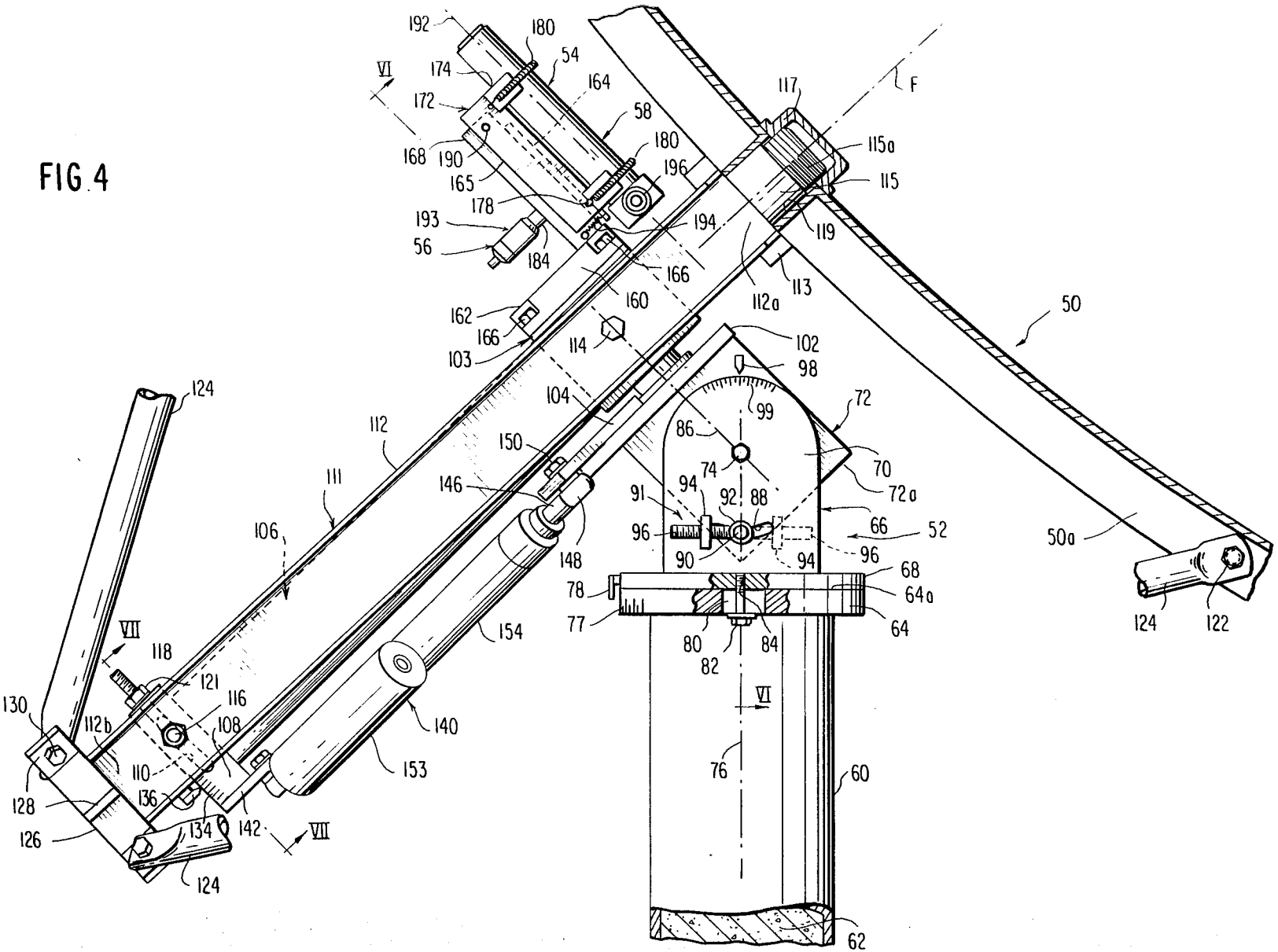
FIG. 4 is a side elevational view of a segment of a parabolic antenna and the polar mount and telescope fixture forming one embodiment of the present invention.

Referring next to FIG. 4, that figure shows in vertical elevation a portion of parabolic antenna indicated generally at 50 which is mounted for boresight alignment on a polar mount, indicated generally at 52. Polar mount 52 incorporates as an integral element thereof, or as an attachment thereto, a Polaris alignment fixture or assembly indicated generally at 54, which fixture includes a sine bar adjustment mechanism indicated generally at 56 as a primary element thereof for providing the desired angle of the upturned tilt of optical alignment axis of telescope 58 with respect to the polar mount rotation axis of antenna 50.

In the specific form shown, mount 52 is provided with a vertical post or pedestal 60 which may comprise a hollow steel pipe or the like which may for instance be ten or more feet in length. Its lower end is set in concrete 62 and it is filled with concrete so as to provide a very solid base for the polar mount 52 and for the parabolic antenna 50 carried thereby. Keeping in mind that such parabolic antennas have diameters on the order of 8 feet, 12 feet, etc., particularly in high winds, heavy compression and tension forces are exerted on the mount and the support structure for the antenna. The steel pipe forming pedestal 60, may be mounted within an auger drilled hole and filled with concrete to provide the desired mass and rigidity to the mount and the antenna 50 supported thereby. The pedestal 60, at its upper end, terminates in a disc-like flange 64, the pedestal preferably being set at true vertical and thereby providing a top or upper surface **64*a*** which is perfectly flat and horizontal.

This would need to be true for a mount conventionally aligned; indeed, the more nearly plumb the post, the more accurately the mount would track. However, the problem in the field is achieving near-perfect perpendicularity, setting the post, then embedding and filing it with concrete. Further, there may be also the problem of, after the concrete had set, the post being found to be less than perfectly plumb. According to the new method of alignment of this invention, plumbness has no relationship to alignment accuracy; the post need only be plumb enough to not offend the eye of the beholder.

Mounted on the top of the pedestal is a U-shaped elevation adjustment member or yoke, indicated generally at 66, comprising a disc-like base 68 and laterally opposed sidewalls 70 rising vertically upwardly therefrom parallel to each other, and rotatably bearing a polar mount member or trunion indicated generally at 72. Polar mount member 72 is of hollow cubic form and pivotably mounted for rotation about a horizontal axis by way of transverse bolts 74. Bolts 74 pass through holes in opposite sidewalls of 70, through machine holes in the adjacent walls of polar mount member 72 and into nuts welded to the inside surfaces of member 72. When pedestal 60 is placed in the ground, it is placed so that a scale indicated generally at 77 being fixed to disc portion 64 and which extends to the right and left of a point is purposely aligned with the earth's north pole. This can be achieved by means of a simple hand-held compass. By rotation of the yoke 66 about a vertical axis and on top of pedestal 60, a fixed pointer 78 moves to a position on scale 77 tantamount to a near north orientation, thereby boresight F of antenna 50 is aligned generally with the satellite track, FIG. 2. In order to adjust the rotational position of yoke 66 relative to pedestal 60, disc 64 is provided with a plurality of slots as at 80 and locking screws 82 passing through the slots are threaded to tapped holes 84 within disc or base **68*a* of the yoke 66. By loosening the adjustment screws 82, the yoke 66 may be manually rotated about its vertical axis 76 to a desired position as determined by pointer 78 and scale 77, and locked thereat. This gives general longitude orientation to the parabolic antenna 50**.

As mentioned previously, the sidewalls 70 of yoke 66 define an opening within which is positioned the polar mount member 72. In order to adjust axis 86 of the polar mount member 72 relative to the vertical axis 76 of the pedestal, both yoke sidewalls 70 bear aligned arcuate slots 88 through which project transversely, horizontal bolts 90 from opposite sides, the bolts 90 being fixedly mounted to the polar mount member 72 adjacent a bottom edge **72*a*, near one corner. Further, each bolt 90 bears a roller as at 92. Projecting from opposite sidewalls 70, are brackets 94 which threadably carry oppositely directed adjustment bolts or screws 96, the inner ends of which bear on the periphery of rollers or discs 92 such that by rotating the adjustment screws, the bolts 90 are forced to move within the arcuate slots 88, thereby providing a greater or lesser angle of inclination of the polar mount member 72 relative to the pedestal 60, that is, between axes 86 and 76**, respectively, of those members to provide elevation adjustment to the antenna.

The polar mount member 72 fixially bears a pointer as at 98 whose pointed end is displaced slightly from the arcuate edge 70*a* of a given sidewall 70 of the yoke 66. Along that edge is provided a scale at 99 to indicate the degree of inclination of the polar mount member 72 with respect to the vertical axis 76 of pedestal 60. By the utilization of the elevation adjustment mechanism, indicated generally at 91, the boresight of parabolic antenna 50 may be oriented generally for the latitude position of site S at which the antenna is physically located on the earth 10. Antenna 50 is mounted to the polar mount member with its boresight generally at right angles to polar mount pivot axis 86 for the antenna and the antenna is in rough alignment with the satellite track sector.

Figure 6:
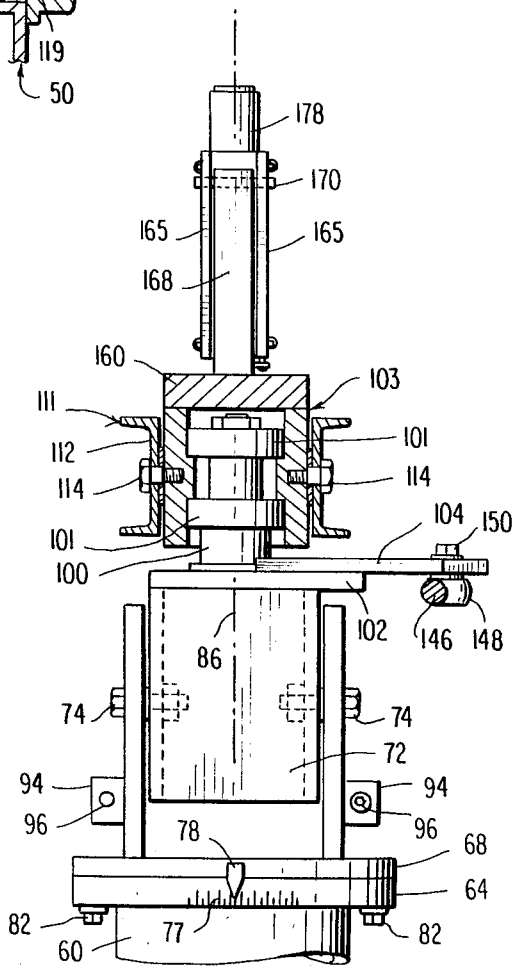
FIG. 6 is a sectional view taken about line VI—VI of FIG. 4 with the antenna pivoted such that its bore site is at right angles to the axis of the pedestal of the polar mount.

In the illustrated embodiment, FIG. 6, the polar mount member 72 is of boxlike or cubic form and a rigid cylindrical post 100 projects outwardly of upper face 72*a* of the polar mount member. Post 100 rotatably supports on the mount member 72, by a suitable bearings 101 an antenna mount member or block 103 for rotation about axis 86. The bearings may be preloaded tapered roller bearings. At the point where the post 100 projects above the upper surface 72*a* of the polar mount member 72, the polar mount member is provided with an integral, or bolted on plate 102. Plate 102 carries projecting rotor arm or moment arm 104. Fixed to antenna mount member or block 103 and projecting radially outwardly therefrom is a beam or antenna carrier 106 which extends several feet beyond axis 86 of the polar mount member 72 and the rotatable post 100. Beam 106 may be welded at end 106*a* to block 103. At the outboard end 106*b* of beam 106, there is fixedly mounted a declination angle adjustment bar 108. Bar 108 is at right angles to beam 106. An elongated arcuate slot 110 extends transversely through the bar 108 from side to side.

In turn, a pair of channel members 112 which are mounted back to back and spaced some distance from each other form a rigid channel bar assembly or antenna boom 111 via end plates 113 and 126. End plate 113 is fixed to the antenna 50, as close to the post 100 as possible. End plate 113 has welded thereto, a stub axle 115, threaded at 119. Threaded to axle 115 is cap 117 locking the center of the antenna 50 to end plate 113 at right angles to channel bar assembly 111. Channel member 112 pass by opposite sides of block 103 and assembly 111 is pivotably mounted to the block 103 by way of screws 114 which project through the sides of the channel members 112, at this point, and are threaded to block 103. The outboard ends 112*b* of the channel bars bear a transversely extending bolt or rod 116 which passes through the arcuate slot 110 within bar 108. Bolt 116 bears nut 123. Threadably mounted to bar 108 is a declination adjustment screw 118 oriented parallel to the major axis of bar 108 and having one end in contact with bolt 116 such that the angle between the beam 106 and the assembly made up by the channel bars 112 may be readily varied by rotating set screw 118, thus displacing the focal axis or boresight F of antenna 50 relative to the normal to the pivot axis 86 passing through post 100 which bears that assembly. A nut 121 clamps set screw 118 at adjusted position. Nut 123 is tightened on bolt 116 to clamp bar 108 between channels 111 and 112, in position determined by adjustment of setscrew 118.

Since the antenna is subjected to heavy deflection forces due to the wind at the situs of the antenna, it is necessary to reinforce the coupling between inboard ends 112*a* of the channel bars 112 and the antenna 50. As may be appreciated, the antenna 50 is segmental in form having "orange peel" sections flanged as at 50*a* with the flanges being bolted together at bolt holes through which bolts 122 pass. The flanges provide excellent means by which a number of reinforcing struts 124 may be bolted at one of their ends, while at their opposite ends, the struts are coupled to end plate 126. End plate 126 is welded to the outboard ends 112*b* of the channel bars, remote from antenna 50, and spans between the channel bars. The plate 126 includes a plurality of radially projecting fingers as at 128, at spaced circumferential points. The fingers bear bolts 130 which project through the ends of the struts and fingers and nuts are applied thereto, thereby mechanically locking the other end of the struts 124 to channel bar assembly 121. Some of the struts 124 are coupled at their opposite ends to flanges 50*a* of the antenna sections, radially inwardly of the periphery of the antenna, while other truts, which are longer, are coupled to the same flanges near the periphery of the antenna giving a high degree of rigidity to the assembly carried by the polar mount. Since the function of the beam 106 and channel bar assembly 111 is to provide the desired declination setting based on latitude of site S, a declination scale 134 is required. Declination scale 134 in this embodiment is carried on a side face of bar 108 and a pointer as at 136 is fixially carried by movable channel bar 112 adjacent thereto for indicating the declination angle, that is, the angular displacement between the longitudinal axis of fixed beam 106 and the pivotable channel bar assembly 111 to which the antenna 50 is rigidly attached, and thus the antenna boresight relative to the normal to the polar axis of the polar mount.

Figure 5:
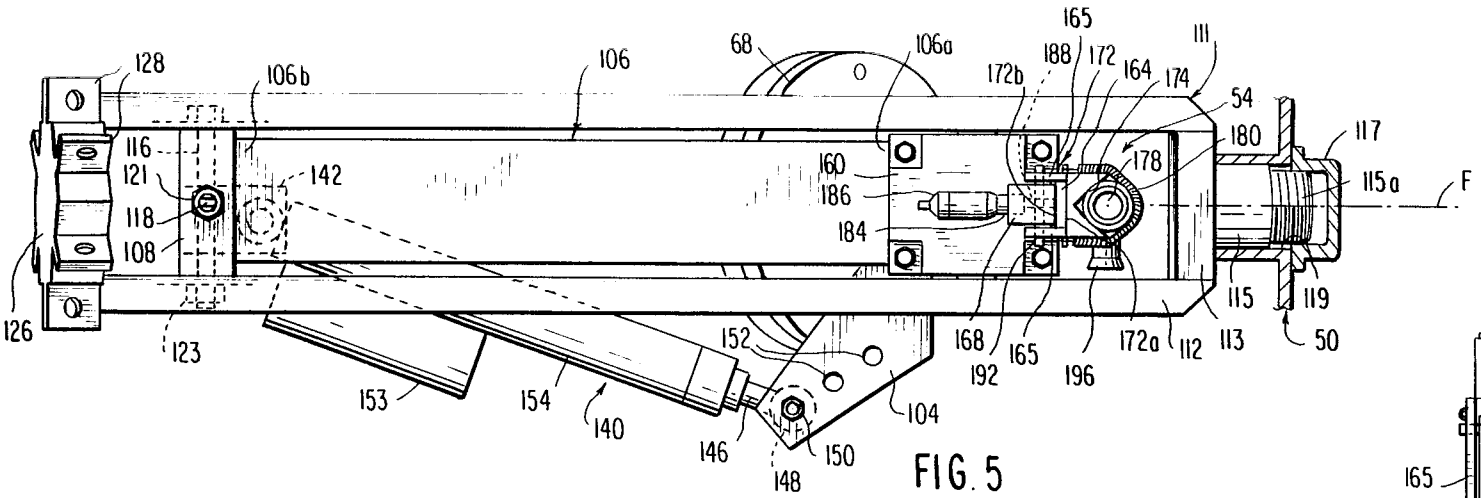
FIG. 5 is a top plan view of the polar mount and telescope fixture of FIG. 4.
Figure 7:
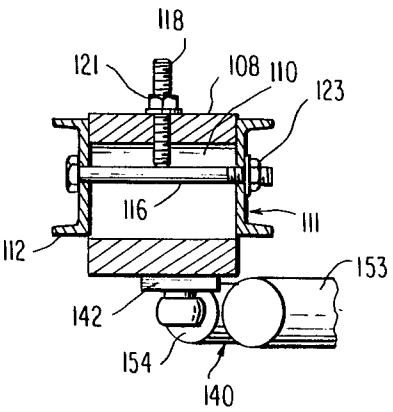
FIG. 7 is a sectional view of a portion of the polar mount taken about line VII—VII of FIG. 4.

As may be appreciated from the prior discussion, once the antenna has been properly aligned so that its boresight F intersects the satellite track sector, by pivoting the antenna 50 about the polar axis as defined by the polar mount, the antenna 50 may be swept through the complete satellite track sector bearing the satellites and is stopped when the boresight intersects a given satellite to which it is then locked. In order to achieve that sweep, the polar mount is provided with a linear actuator indicated generally at 140. Projecting outwardly from 108 the lower end of the declination bar 108, is a mounting clock 142 to which mounts one end of linear actuator 140. Linear actuator 140 is of the zero backlash type and comprises an electrical motor driven mechanism of cylindrical form. The linear actuator 140 is a conventional commercial worm cylinder having an extensible and retractable actuator rod 146 connected at its outboard end to moment arm 104 by way of a sealed rod end bearing 148. Sealed rod end bearing 148 may be bolt connected by bolt 150 at one of three locations defined by holes 152 within the end of the moment arm 104 remote from post 100. This provides a mechanism whereby the extent of arcuate drive of the antenna about the polar axis may be varied depending on the angular extent of the satellite track sector which must be swept to insure signal reception from all of the synchronous satellites within the sector in question. Moment arm 104 extends rigidly from plate 102, being permanently attached thereto. Plate 102, otherwise circular in outline, is secured to cube 72 by a number of clamping bolts (not shown) arranged in a circular pattern. These bolts pass through arcuate slots in plate 102 into threaded holes in cube 72, the slots so disposed as to allow plate 102 and with it, moment arm 104, to be rotated, and finally clamped securely by the bolts in such a direction as will enable actuator 140 to sweep the complete relevant sector whatever the longitude of the antenna. This direction is pre-set during the assembly of the system, according to a longitude scale (not shown) located on the perimeter of plate 102. The linear actuator 140 is comprised of two cylindrical sections, the larger being the drive box as at 153 and the smaller comprising the worm cylinder member as at 154, from which actuator rod 146 projects. Extension of the actuator rod 146 causes assembly 111 to pivot clockwise, FIG. 5, with moment arm 104 fixed.

Forming a principal component of the polar mount 52 or functioning as a separate attachment for an existing polar mount, is the Polaris alignment fixture 54 forming a key component of the present invention. In the illustrated embodiment, block 103 bears a plurality of tapped holes. This permits a base member 160 of the Polaris alignment fixture 54 to be mounted thereto. In the illustrated embodiment, base member 160 is of rectangular plan form and comprises a plate whose corners are recessed as at 162. Recesses 162 bear holes through which mounting screws 166 protrude, the screws being threaded to block 103 of the polar mount member. Base member 160 fixially supports a right vertical angle riser as at 168 at one end to which is pivotably mounted, a finder telescope cradle or mount indicated generally at 172. The cradle 172 includes an end wall 164 and side walls 165, saddling riser 168. Saddles 174 at the upper and lower ends of the cradle 172 project outwardly from the face 172*a* of the cradle away from riser 168 and defining "V" blocks 174 in which the main tubular body 176 of Polaris finder telescope 58 is supported.

While various means may be provided for mounting the telescope to the cradle 172, in the illustrated embodiment, pins project as at 178 from opposite sides of the cradle 172, above and below the saddles and helical coil springs 180 are coupled at opposite ends to the projecting pins 178, on opposite sides of the cradle 172, to resiliently encircle the main tubular body 176 of telescope 58. The saddles 174 are identical and are machined so that without particular adjustment, the optical sighting axis 192 of the telescope barrel 176 is aligned with the polar pivot axis 86 of the polar mount member. The cradle 172 is pivotably mounted to the upper end of riser 168 by a pivot pin 190 which extends transversely through the riser and from one sidewall 165 of the cradle 172 to the other. Advantageously, the present invention adds to the telescope mount a sine bar indicated generally at 193 which is a tool room device for accurate measurement of angles, thereby forming a fixture by which the "tilt" angles indicated in the printout above can be precisely transferred from the axis of the finder telescope 58 to the pivot of the mount. In that respect, the riser 168 mounts micrometer 56 by way of a barrel portion 184. Micrometer 56 includes an adjustment knob or micrometer head as at 186. The micrometer 56, mounted to the lower end of the riser 168, includes an actuator pin 188 bearing on the lower end of the cradle 172, against wall surface 172*b* thereof. By rotating the micrometer head 186, optical axis 192 of the finder telescope 58 is displaced in the plane of longitude of the site to insure boresight accuracy in its attempt to align with a given satellite and with the satellite track sector. Thus, the fixture achieves a transfer of the angles stated by the computer printout and achieved from the formulae above, to the pivot of the mount. As indicated, the micrometer 56 forms part of sine bar 193, and is adjusted to the read the sine of the required angle.

In the illustrated embodiment, a five inch sine bar is employed in order to expand the scale so that the natural sine of the required angle is multipled by five, and this is the number set on the micrometer 56. It is readily found in the printout above, for any increment of latitude, within the column heading "Sine Set". Since the finder telescope 54 is resiliently coupled (or fixedly attached) to the cradle 172 and since the cradle 172 pivots relative to the riser 168, a tension spring 194 is connected at one end to the cradle, remote from the pivot axis defined by pin 190, and its other end is connected to riser 168 to insure that when the micrometer 182 is rotated to a position of zero angular deviation between the axis 192 of the finder telescope and the polar mount pivot axis 86, the cradle 172 is spring biased flush with the face of riser 168, to which it is attached, and parallel thereto.

Telescope 58 is conventional, being provided with a scope eye piece as at 196 which projects outwardly from the lower end of the main barrel 176 of the telescope at right angles thereto and permits easy visibility sighting when the Polaris alignment fixture is attached to the polar mount for the requisite antenna.

In operation, if a Polaris alignment fixture 54 is not provided on a polar mount capable of operating under the method of the present invention, such alignment fixture or optical aligning device 54 must be rigidly mounted to block 103 (or its equivalent) of a polar axis mount member 72 and with its axis and the sighting axis of the finder telescope 78 parallel (absent sine bar adjustment).

The first step in accurately aligning the boresight F of the antenna 50 with a satellite track sector and for sweeping the satellite sector is the adjustment of the micrometer 56 by rotation of micrometer head 186 to the number found in the "sine set" column of the printout, opposite the latitude of the site.

The polar mount is then roughly aligned for true north using a pocket compass by loosening the adjustment bolts 82 and manually rotating the base 68 of yoke 66 on the pedestal or post 60 by use of a pocket compass, then roughly aligned for elevation using the latitude scale at 99 found on sidewall 70 of the yoke 66. If this is done with reasonable care, then at twilight, the North Star or Polaris will appear in the field of the telescope through eyepiece 196. Then, by use of the adjustments on the polar mount, Polaris is precisely centered in the reticle of the telescope. It must be appreciated that once the sine set adjustment is made by way of micrometer 56 of the Polaris alignment fixture 54, no change is made at the instrument. However when the adjustments are made on the mount itself, i.e., by way of screws 82 and adjustment set screws 96 to place Polaris precisely centered in the reticle of the telescope, the optical aligning device or Polaris aligning fixture 54 may be removed.

Purposely, in the description of the present invention, the electronics associated with the antenna have not been described nor are they shown in the drawings to simplify matters. However, as may be appreciated, during the final adjustment steps, the electronics must be in working order and the TV set turned on to visually see the results of the mechanical adjustments. Since, other than having the site S for the antenna at the equator, there must be some adjustment for dip, that is, declination, as such, this is provided on the mount by way of declination scale 134 through declination adjustment bolt 116. The adjustment for dip or declination is made based on the figure given in the "dip" column of the computer printout opposite the latitude of the site. At this point, the antenna 50 is pivoted by means of the linear actuator 140 until a signal is received from one of the satellites within the satellite track sector. The dip adjustment via adjustment screw 116 is fine tuned to get the best picture from that particular satellite. If all the steps above have been correctly done, then a signal from any of satellites 14–36 inclusive will be received as well as it can be, at the particular antenna site, without adjusting anything other than the antenna pivot angle about the polar mount by way of the linear actuator 140.

As may be appreciated, the Polaris alignment fixture may be used to align any polar mount adapted for it. The invention, in terms of the fixture, is used initially to align the polar mount whereupon the polar axis remains fixed for the satellite track sector in question. Obviously such fixture need not be supplied with every mount nor permanently attached thereto. However, it may be integrated with a polar mount as an element of that combination.

It must be conceded that there is an error of about 30 arc-seconds relative to the polar axis and the position of Polaris, since Polaris is not in exact alignment with the earth polar axis. Compensation for this minor misalignment may be incorporated within the fixture 54. However, this error is not believed to be significant when compared to the latitude problem caused by the site location remoteness from the equatorial place.

The linear actuator 140 employed in the present polar mount of this invention has zero backlash even under considerable load in order to minimize deflection and loss of signal strength in windy weather and may employ hardened round ball screws with preloaded recirculating ball nuts. However, the costs are relatively high. By the utilization of plain nuts separated by a torsion spring to the limit of their confinement, the anti-backlash movement is simplified.

As may be appreciated, systems currently in use for aligning TVRO polar mounts contain an inherent error of up to one-fourth degree, depending upon the location of the mount. Additional errors undeterminable but substantial are introduced by primitive aligning tools and the personnel employing the same. The present invention reduces the calculated alignment error to 44 arc-seconds maximum depending upon location, and enables the technician to apply this accurately to the actual alignment process within 30 arc-seconds and with alignment achieved within a relatively short time, requiring only the mounting of the Polaris alignment fixture and the presetting of the finder telescope to incorporate the adjustment minimizing the distance between the imaginary cone track at the site of the TVRO antenna and the actual satellite track at the earth's equatorial plane. The accuracy attainable by the present invention including the method of alignment exceeds normal requirements of the present state of the art. However, its application eliminates misalignment as a possible cause of poor performance in a particular system, and future refinement in other elements of these systems must ultimately depend for their effectiveness on alignment accuracy of this order.

While the invention has been particularly shown and described with reference to a preferred embodiment thereof, it will be understood by those skilled in the art that various changes in form and details may be made therein without departing from the spirit and scope of the invention.

What is claimed is:

1. A method for closely aligning a TVRO antenna or the like with an earth equatorial satellite track sector bearing a plurality of satellites within said sector to permit rapid selective alignment of the antenna boresight with a given one of said satellites, said method comprising:

mounting said antenna at a site location on the earth's surface with the antenna boresight generally directed toward said sector, rotating said antenna about a first, polar axis parallel to the earth's polar axis to provide longitude orientation of said antenna, rotating said antenna about a second axis at right angles to the first rotation axis to orient the antenna in elevation corresponding to the earth's latitude position for the antenna, and wherein rotation of the antenna about said first axis creates a boresight cone which overlaps the satellite track, and tilting the axis of the boresight cone out of parallel to the earth's polar axis in the plane of longitude through the antenna site to generate an ellipse whose long axis or short axis, at both ends, lies tangent to the satellite track to maximize boresight alignment of the antenna with a given satellite within said satellite track sector, and wherein the boresight of said antenna is at right angles to the polar axis of rotation of said antenna:

the center of the earth comprises the point 0;

the site of the satellite on the earth's surface is S;

points A and A' are diametrically opposite intersection points on the satellite track of a plane passing through the earth's longitude at site S;

Λ is the angle between the earth's equatorial plane and the antenna site S;

the antenna is provided with a declination or dip angle in the longitude plane and away from the earth's polar axis equal to half the sum of the angles SAO and SA'O, and;

the angle of tilt of said boresight cone out of parallel to the earth's polar axis equals half the difference between the angles SAO and SA'O;

with the relationshiop;

where AO=A'O=the radius of satellite orbit=26,279 miles and

SO=the radius of the earth taken as 4,000 miles, such that;

$$\text{angle } SAO = \tan^{-1} \frac{4{,}000 \text{ sine } \Lambda}{26{,}279 - 4{,}000 \text{ cosine } \Lambda'}$$

and $$\text{angle } SA'O = \tan^{-1} \frac{4{,}000 \text{ sine } \Lambda}{26{,}279 + 4{,}000 \text{ cosine } \Lambda'}.$$

2. An apparatus for closely aligning a TVRO antenna or the like with an equatorial satellite track sector to permit rapid selective alignment of the antenna boresight with a given one of multiple satellites within said satellite track sector, said apparatus comprising:

a fixed base member, a vertical axis pedestal fixedly mounted on said base member, a longitude adjustment member rotatably mounted on said pedestal for rotation about the pedestal axis to provide longitude orientation of said antenna, an elevation adjustment member mounted to said pedestal for rotation about a horizontal axis intersecting the vertical axis of said pedestal for latitude adjustment of said antenna, a polar mount member mounted to said elevational adjustment member and including an antenna mount member mounted for rotation about a polar mount pivot axis at right angles to the horizontal pivot axis of said elevation adjustment member, said polar mount pivot axis being parallel to the polar axis of the earth bearing the TVRO antenna, means for fixing said antenna to said antenna mount member with its boresight axis generally at right angles to the axis of rotation of the antenna mount member, and a Polaris alignment fixture mounted to said antenna mount member and bearing a finder telescope having an optical sighting axis normally parallel to the axis of the rotation of the polar mount member, means for tilting the sighting axis of the finder telescope relative to the polar mount pivot axis in the plane of longitude of the antenna site to effect tilting of the axis of a boresight cone created by rotation of said antenna about the polar mount pivot axis out of parallel to the earth polar axis in the plane of longitude through the site of said antenna to generate an ellipse whose long or short axis at both ends lies tangent to the satellite track to adjust for antenna boresight alignment error created by the latitude of the TVRO antenna site.

3. The apparatus as claimed in claim 2, wherein said Polaris alignment fixture comprises a telescope mount fixed to said polar mount member and having a planar surface extending parallel to the axis of rotation of the antenna mount member and a sine bar adapter carried by telescope mount and operatively engaging said finder telescope for inclining the optical axis of the telescope at an angle to the earth's polar axis in the longitude plane of the site of the antenna.

4. A polar mount for closely aligning a TVRO antenna or the like with an equatorial satellite track sector to permit rapid selective alignment of the antenna boresight with a given one of multiple satellites within said satellite track sector, said polar mount comprising:

a fixed base member, a vertical axis pedestal fixedly mounted on said base member, a longitude adjustment member rotatably mounted on said pedestal for rotation about the pedestal axis to provide azimuth orientation of said antenna, an elevation adjustment member mounted to said post member for rotation about a horizontal axis intersecting the vertical axis of said pedestal for elevation adjustment of said antenna, a polar mount member mounted to said elevational adjustment member for rotation about an axis at right angles to the horizontal pivot axis of said elevation adjustment member and bearing a post defining a polar mount pivot axis parallel to the polar axis of the earth bearing the TVRO antenna, an antenna mount member rotatable on said post antenna means for mounting said antenna to said mount member with its boresight axis generally at right angles to the axis of rotation of the polar mount member, said antenna mounting means comprising a pair of parallel, laterally spaced elongated bars, plates fixedly coupling the ends of the bars together to form a rigid bar assembly, said antenna being fixedly mounted at its center to one of said plates at one end of said bar assembly with the antenna boresight parallel to the axis of said bar assembly said bar assembly adjacent said end bearing said antenna means for pivotably mounting to said antenna mount member at right angles thereto, a beam fixed to said antenna mount member and rotatable therewith and extending parallel to the gap formed by the parallel bars, away from the post, and terminating short of the other plate connecting said bars remote from said antenna, a declination bar fixedly mounted at right angles to the end of the said beam remote from said polar mount post and projecting into the gap between said parallel bars, an arcuate longitudinal slot carried by said declination bar intermediate of the ends thereof and extending transversely through said declination bar, a rod projecting transversely between said bars adjacent the end thereof bearing said declination bar and extending through said arcuate slot, and a declination adjusting screw threadably mounted to said declination bar and having an end bearing on said rod whereby, threading or unthreading of said declination adjustment screw functions to increase or decrease the angle between said beam and said bar assembly and to thereby vary the angle of dip of said antenna boresight to compensate the antenna for the latitude position of the antenna sight with respect to the satellite track.

5. The polar mount as claimed in claim 4 wherein said antenna comprises a parabolic antenna facing away from the bar assembly, and wherein, a plurality of struts are fixedly mounted at one end to the end of said bar assembly remote from the polar mount and at their opposite ends are rigidly connected to the parabolic antenna radially outwardly of the end of said bar assembly to which the center of the antenna is mounted.

6. The polar mount as claimed in claim 5 wherein, said plate remote from the polar mount pivot axis comprises a plurality of radially projecting circumferentially spaced fingers and wherein, the struts, at one end, are bolted to said fingers, respectively.

7. The polar mount as claimed in claim 6 wherein, said antenna comprises a plurality of flanged sections with said flanges extending radially and being bolted together at points along the radial extent thereof, and wherein, the other ends of certain of said struts are bolted to the flanges at points intermediate of the axis of the antenna and the periphery of the same while, the other end of others of said struts are bolted to said flanges at the antenna periphery to form a rigid assembly with said struts functioning to take up for compressive and tension forces exerted through the polar mount in response to high velocity winds acting upon the polar mounted antenna.

8. The polar mount as claimed in claim 4 wherein, said polar mount post comprises a moment arm integral therewith and extending radially outwardly thereof adjacent the end of said beam fixed to said polar mount member, and wherein, a zero backlash actuator is fixedly mounted at one end to said beam remote from said polar mount member and includes an actuator rod projecting axially from the opposite end thereof and wherein, means are provided for coupling the end of said actuator rod to said moment arm whereby, operation of said actuator results in controlled arcuate movement of the antenna through said bar assembly to the angular extent of the satellite track sector to permit selective signal reception from any one of the synchronous satellites within said sector.

9. The apparatus as claimed in claim 4 wherein said Polaris alignment fixture comprises a base plate fixedly mounted to said antenna mount member, a riser extending at right angles to said plate and having a planar surface extending parallel to the axis of rotation of the antenna mount member, an elongated cradle having saddles at respective ends defining "V" blocks, said finder telescope including an elongated barrel defining the optical sighting axis, means for fixedly mounting said telescope barrel within said "V" blocks, and means for pivoting the end of the cradle to the end of said riser remote from said base, a micrometer sine bar fixedly mounted to the riser adjacent said base having an actuator rod operatively engaging the face of said cradle facing said planar surface of said riser and a micrometer operating head for manual adjustment of said actuator rod whereby, rotation of said micrometer head causes said cradle to pivot on said cradle pivot axis to incline the optical axis of the telescope at an angle to the earth's polar axis in the longitude plane of the sight of the antenna bearing said Polaris alignment fixture.

10. The apparatus as claimed in claim 9 wherein, coil springs fixed at respective ends to opposite sides of said cradle encircle said telescope barrel to resiliently mount the telescope to the "V" blocks and wherein, a coil spring is fixed at one end to the riser, and at the opposite end to the cradle remote from the cradle pivot axis to resiliently bias the opposed faces of said cradle and said riser in flush surface contact absent a sine bar micrometer adjustment to a sine set value corresponding to the latitude of the antenna sight.

* * * * *